United States Patent [19]

Honda et al.

[11] Patent Number: 4,827,630

[45] Date of Patent: May 9, 1989

[54] HEATING PLATE IN A VENEER DRYER

[75] Inventors: Noriyuki Honda; Yukio Abe; Makoto Isobe; Nobuhiro Nakata, all of Obu, Japan

[73] Assignee: Meinan Machinery Works, Inc., Obu, Japan

[21] Appl. No.: 132,994

[22] Filed: Dec. 15, 1987

[51] Int. Cl.[4] ..... F26B 9/04

[52] U.S. Cl. ..... 34/146; 34/143

[58] Field of Search ..... 34/143, 41, 144, 146, 34/145

[56] References Cited

U.S. PATENT DOCUMENTS

| | | | |
|---|---|---|---|
| 1,349,384 | 8/1920 | McIntire | 34/143 |
| 3,896,559 | 7/1975 | Martin . | |
| 4,188,878 | 2/1980 | Kuhnau | 34/143 |

FOREIGN PATENT DOCUMENTS

| | | | |
|---|---|---|---|
| 5224085 | 7/1975 | Japan . | |
| 5934872 | 5/1981 | Japan . | |
| 752863 | 7/1956 | United Kingdom | 34/143 |

*Primary Examiner*—Henry A. Bennet

*Attorney, Agent, or Firm*—Brooks Haidt Haffner & Delahunty

[57] ABSTRACT

A heating plate is disclosed which is adapted for use in a dryer for drying a sheet of wood veneer by heating said plate at a desired level and placing one surface of the plate on either side thereof in engagement with the veneer sheet. The heating plate, when heated and placed in non-engagement state, is formed such that said one surface is convex shaped.

7 Claims, 4 Drawing Sheets

HEATING PLATE IN A VENEER DRYER

FIELD OF THE INVENTION

The present invention relates to a heating plate adapted for use in a contact or press type dryer for heating and drying wood veneer.

BACKGROUND OF THE INVENTION

In drying a sheet of wood veneer, a so-called contact or press type dryer is known. In this dryer, a veneer sheet is dried by a plate which is heated to a desired level by any suitable means such as steam, heated oil, electrical heater, etc. and brought into direct contact engagement with the veneer sheet to be dried, as disclosed by Publication of Examined Japanese Patent Application No. 52-24085 (1977) for "Method of drying veneer", or by a similarly heated plate which is brought into contact with an intermittently movable steel belt used as means for intermittently conveying the veneer sheet through the dryer and also for allowing the heat from the plate to conduct therethrough to the veneer sheet when the belt is at a stop during its intermittent movement and while it is then placed in contact with the sheet, as disclosed by Publication of Examined Japanese Utility Model Application No. 59-34872 (1984) for "Continuous press dryer for sheet material such as thick veneer". Besides the above two veneer dryers, various changes and modifications therefrom have been disclosed by similar publications.

As compared with a so-called hot air type in which the veneer is dried by heated air enforced to circulate in a conditioning chamber or a dry kiln, the above contact type dryer is known to offer an advantage in thermal efficiency in drying operation. The heating surface of the plate that is to be in engagement directly with the veneer sheet or indirectly via the conveying belt has been usually formed so as to present a flat surface when the plate is placed in its inoperative or non-engagement position away from the veneer sheet.

With a heating plate having one surface on either side thereof engageable with the veneer directly or indirectly, however, a problem will be encountered with, as will be described below, if the engageable surface of the heating plate is formed so as to present a flat surface in its inoperative condition.

When the heating plate is brought into a contact engagement with an incoming green veneer sheet containing a noticeable amount of moisture and hence relatively cold, the heating surface of the plate is cooled down rapidly by the sheet and consequently contraction stress is produced in the plate adjacent its heating surface in engagement with the cold veneer sheet. Though no fear of the problem will occur if such stress takes place on both opposite surfaces of the plate because of their substantially simultaneous contact engagement with green veneer sheets so that the stresses on the opposite surfaces balance, and therefore offset, each other, if the dryer is so arranged that one surface on either side of the heating plate is engaged directly or indirectly with the cold veneer sheet, that surface will be deformed into a "cup" shape, or curved into a concave form, under the influence of the contraction stress. Consequently, not only the contact of the heating plate with the veneer sheet becomes uneven, so that the efficiency in heat conduction to the veneer sheet is decreased during the critical early period of drying, but also the steam emitted from the wet veneer sheet by drying thereof tends to be confined in a small space formed by the concave-shaped surface, thereby delaying the diffusion of the steam and thus affecting the efficiency in drying. As a result, the veneer sheet is caused to be contracted earlier at its edges than other portions so that a trouble such as cracks or checks may be produced in the veneer sheet in progress.

To prevent the heating plate from being deformed by the contraction stress, the plate may be constructed with an extremely high magnitude of geometrical moment of inertia so as to increase its rigidity to such an extent that can resist the above contraction stress, e.g. by increasing its thickness or providing reinforcement ribs. However, provision of such heating plate will inevitably increase its weight and therefore the manufacturing cost thereof, but also it will make the dryer itself larger in size because of the necessity to construct the plate lifting mechanism strong enough to resist the heavy weight of the plate and also to arrange the veneer conveyer long and large-sized. In addition to such inconveniences, the thermal efficiency of the plate will be reduced because the area of its heat radiation surfaces will be increased.

Alternatively, the heating plate may be pressed directly or indirectly against the veneer sheet until its heating engagement surface becomes substantially flat. However, such pressing by the plate will excessively compress the veneer sheet to thereby reduce its thickness. Therefore, this method, if used, would be limited to drying veneer of special wood material.

SUMMARY OF THE INVENTION

It is an object of the present invention, therefore, to provide a heating plate of contact or press type veneer dryer which can remove the above-identified drawbacks.

To achieve this object, the heating plate according to the present invention has a heating engagement surface on one side thereof formed with a slight outward curve, or convexity, in the desired direction, preferably in all directions across the heating surface, when the plate is in its inoperative state where it is placed in its non-engagement position away from the veneer sheet.

When the heating plate thus constructed is brought into a contact engagement with the wet, cold veneer sheet, it is deformed by the above contraction stress in such a way that the heating surface tends to be flattened, so that the contact engagement thereof with the veneer sheet is more uniform than heretofore. Thus, the fear of the above-mentioned confinement of steam inviting cracks in the veneer sheet can be avoided successfully.

A difference will occur in contact between the center and the edge portions on the veneer sheet in a later period of the drying process when the difference in temperature between the heating plate and the veneer sheet in progress has already been substantially reduced and, therefore, the plate has substantially resumed its original convex shape. Though the amount of steam then emitted from the veneer is reduced, the convex shape of the heating surface can allow the steam from the veneer to emanate freely without being confined as when the surface is concave shaped. In this way, the use of the heating plate according to the present invention can contribute to improvement in contact or press drying of veneer sheet.

These and other objects, features and advantages of the invention will become apparent to those skilled in the art from the following description of a preferred embodiment of heating plate according to the present invention, which description is made with reference to the accompanying drawing.

DETAILED DESCRIPTION OF THE PREFERRED EMBODIMENT

Figure 1:
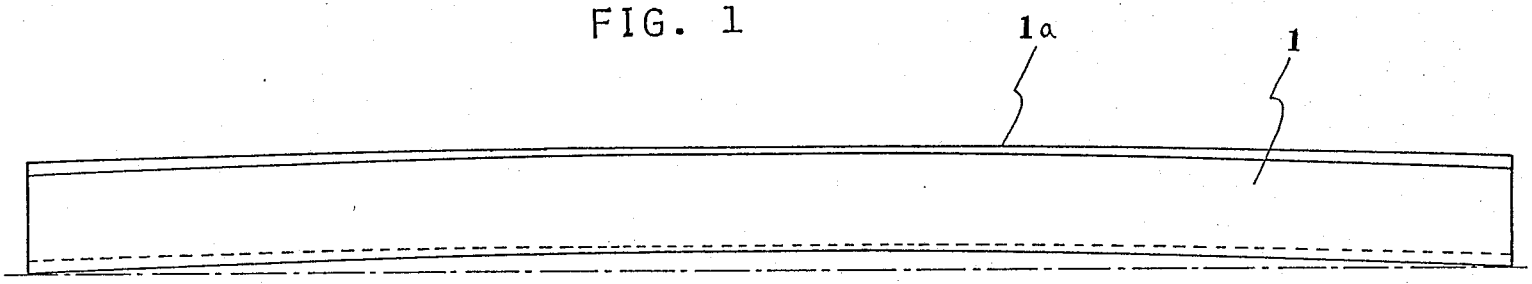
FIG. 1 is a front elevation of a preferred embodiment of heating plate adapted for use in a contact or press type veneer dryer and constructed according to the invention.
Figure 2:
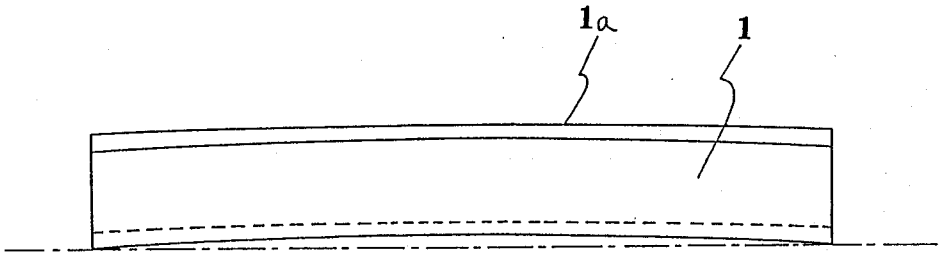
FIG. 2 is a side view of the heating plate of FIG. 1.
Figure 3:
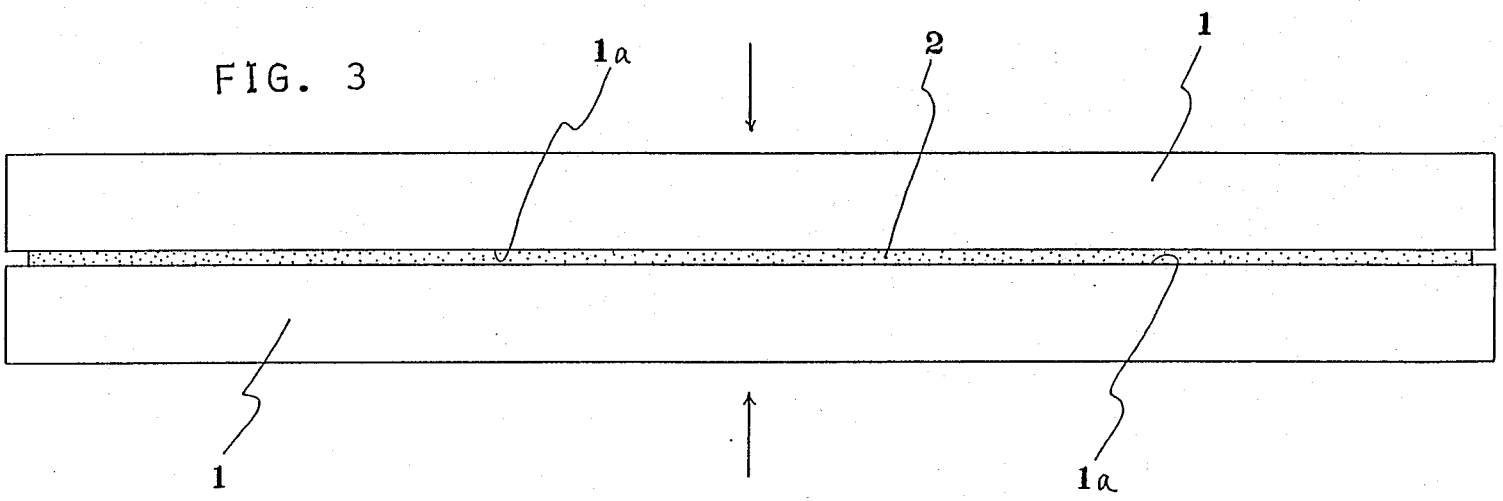
FIG. 3 is a front view of a pair of heating plates of FIGS. 1 and 2, showing their operative state when they are placed in contact engagement with a veneer sheet for drying the same.

Reference is made to FIGS. 1, 2 and 3 showing the preferred embodiment of a heating plate 1 adapted for use in a contact or press type veneer dryer and constructed according to the present invention. The plate 1 has a heating surface 1*a* on one side thereof which is to be placed alternately in contact engagement and non-engagement positions with respect to a veneer sheet 2 (FIG. 3) to be dried. It is to be noted that the heating plate 1 in FIGS. 1 and 2 is shown in its non-engagement state. As seen from the drawings, the heating surface 1*a* of the plate 1 is formed so as to present a slight convexity or a slight outward curve. As will be understood from comparison of FIG. 1 showing the plate 1 in front elevation and FIG. 2 showing the same plate in side elevation, the plate heating surface 1*a* is curved not only in lengthwise and widthwise directions of the plate 1, but also in all other directions across the surface, thus forming a outward curved surface, e.g. like the surface of a sphere. For drying the veneer sheet 2 in contact engagement therewith, the plate 1 is heated to any desired level of temperature by any convenient means such as steam, heated oil, electric heater, etc.

It is to be understood that, for the sake of clarity of illustration, the convexity or the outward curve of not only the heating surface 1*a* in FIGS. 1 and 2, but also the convexity appearing in other embodiments of the invention, are shown somewhat exaggerated.

When the heating plate 1 thus constructed is placed in its operative engagement position as shown in FIG. 3 in which its heating surface 1*a* is pressed in direct contact with the veneer sheet 2 containing moisture to be removed and hence still relatively cold, the veneer sheet 2 absorbs heat rapidly from the plate surface 1*a*, producing contraction stress in the plate 1 adjacent its heating surface 1*a*, as described earlier. Accordingly, the heating plate 1 is deformed by the stress in such a way that the heating surface 1*a* becomes substantially flat. Thus, the contact of the heating plate 1 with the veneer sheet 2 can be more uniform that when the heating surface 1*a* is concave.

Therefore, heat conduction to the veneer sheet 2 during the important early period of the drying process can take place smoothly and the fear of reduction in drying efficiency can be avoided because the steam emitted from the veneer by heating can emanate without being confined in the space under the heating surface, so that the veneer sheet 2 is free from cracks caused by local contraction of the veneer sheet taking place earlier at edges thereof than other portions.

As the drying proceeds close to the end of the process when the difference in temperature between the heating plate 1 and the veneer sheet 2 is substantially reduced, the plate 1 substantially tends to resume its original convex heating surface 1*a*. Though a difference in contact is then produced between the center and the edge areas on the veneer sheet, the convex shape of the heating surface can allow the steam from the veneer to emanate freely without being confined as when the surface is concave shaped.

It is desirable that the eating surface 1*a* of the plate 1 should be formed so as to present a slight convexity of curves not only in lengthwise and widthwise directions of the plate 1 but also in all other directions across the heating surface 1*a*, or preferably an outward curved surface similar to, e.g., the surface formed by a segment of a sphere, so that the heating surface 1*a* may be deformed substantially flat when it is subjected to the contraction stress by the contact engagement with the cold veneer sheet. It is to be understood, however, that the convexity on the heating surface 1*a* is not limited to such an ideal form.

Figure 6:
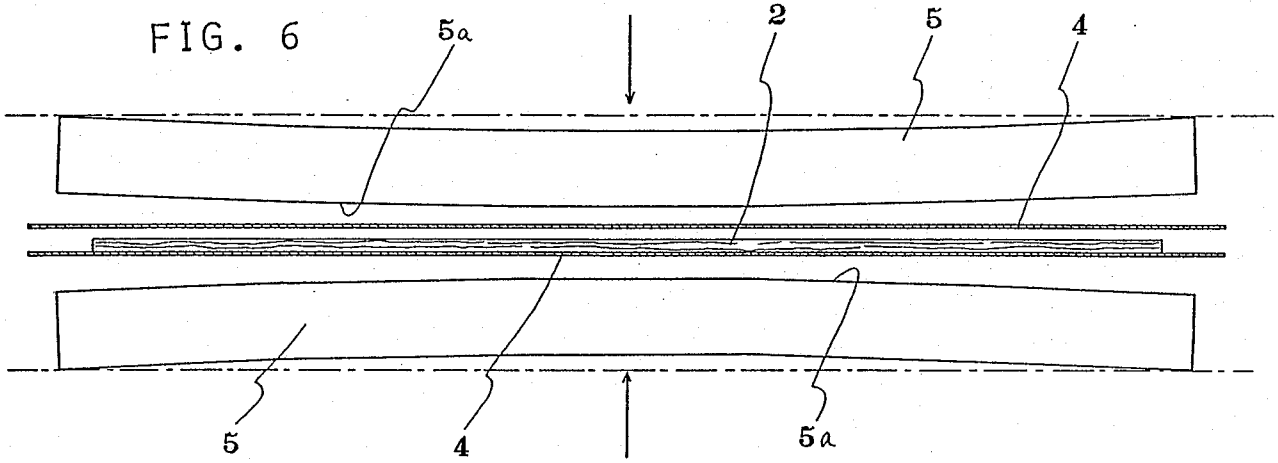
FIG. 6 is a front view of a pair of further modified heating plates, adapted for use in a veneer dryer in which the heating plates are brought in contact engagement with conveying steel belts which are in turn enforced to be in direct contact engagement with a veneer sheet between such belts.
Figure 7:
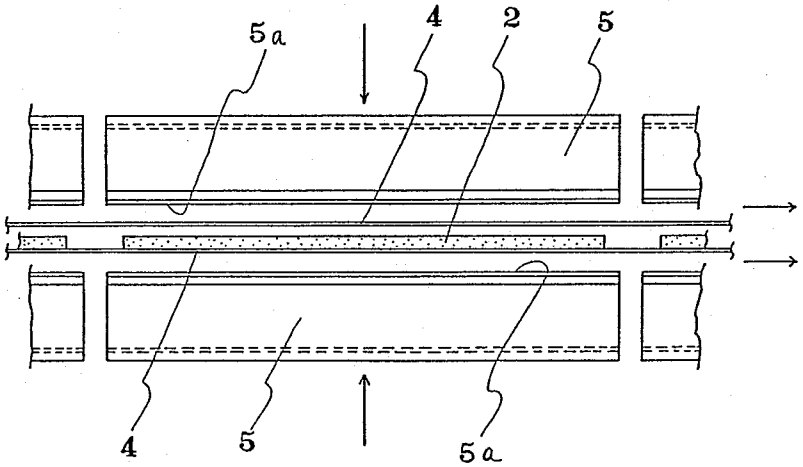
FIG. 7 is a side view of the heating plates of FIG. 6.

Referring to FIGS. 6 and 7 showing another embodiment of the present invention in the arrangement wherein a pair of heating plates 5 is disposed with one above and the other below a pair of steel belts 4, respectively, and the belts are driven to move intermittently in arrow direction (FIG. 7) so as to transfer the veneer sheet 2 through the dryer and also function to conduct heat from the plates 5 therethrough to the veneer sheet 2 when the heating plates 5 are moved from the position shown into contact engagement with their adjacent steel belts 4 which are then at a stop during the intermittent movement. As noted from comparison of FIGS. 6 and 7, each plate 5 has a heating surface 5*a* formed slightly convex only in the lengthwise direction of the rectangular shape of the plate, and such convexity is formed by a series of straight planes as indicated by two solid lines adjacent the heating surface 5*a* and two dash lines adjacent the opposite surface of each plate 5. Though the heating surface 5*a* is formed convex only in one direction, it at least tends to become flat by deformation when subjected to the contraction stress caused by contact engagement with the cold veneer sheet 2 by way of the steel belts 4.

The desirable extent of the outward curve or convexity of the heating surface of the plate should be selected depending on various influencing factors such as the construction of the plate, temperature difference between the plate and veneer, etc. According to the experiment conducted by the present inventors, the convex heating surface formed with a height of about 0.15 to 0.25 mm per 1 m has presented favorable results. Anyway, a heating plate having a convex heating surface on one side thereof which at least tends to be deformed toward flatness can serve for the purpose. In view of the fact that the convex surface at least tends to be deformed toward flatness by the contraction stress, the heating surface of the plate of the present invention may be deformed, when placed in its operative state, to an extent before it is completely flat or even slightly beyond the flatness to thereby present an extremely slight concave shape, though the convex shape before reaching the flatness is more favorable for the heating surface than the concave shape beyond the flatness. Incidentally, it could be found by the present inventors that, in the arrangement of the dryer in which the heating surface presses the veneer sheet indirectly by way of the steel belts as in the embodiment of FIGS. 6 and 7, the convexity on the heating surface could be formed with less accuracy with respect to an ideal form, without affecting the practical application thereof in the veneer dryer. According to the present invention, the convexity on the heating plate surface may be formed by continuous curves as in the embodiment shown in FIGS. 1 and 2, or by a series of straight planes as in the embodiment illustrated in FIGS. 6 and 7.

Figure 8:
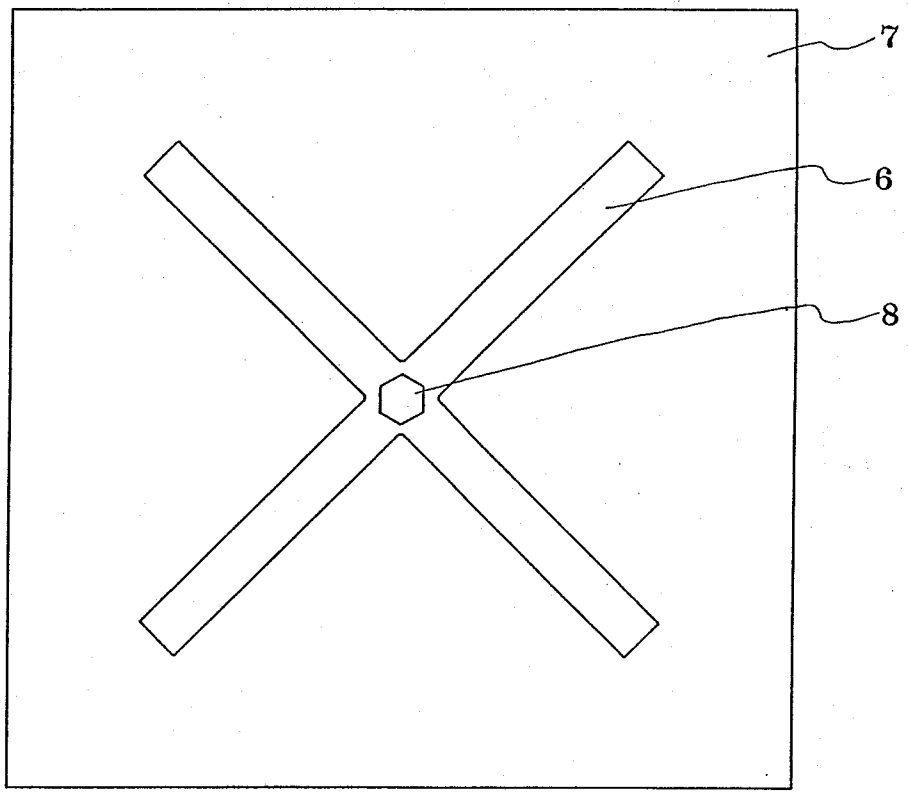
FIG. 8 is a plan view of a further modified heating plate, illustrating a method of providing the heating surface of the plate with the desired convex shape.
Figure 9:
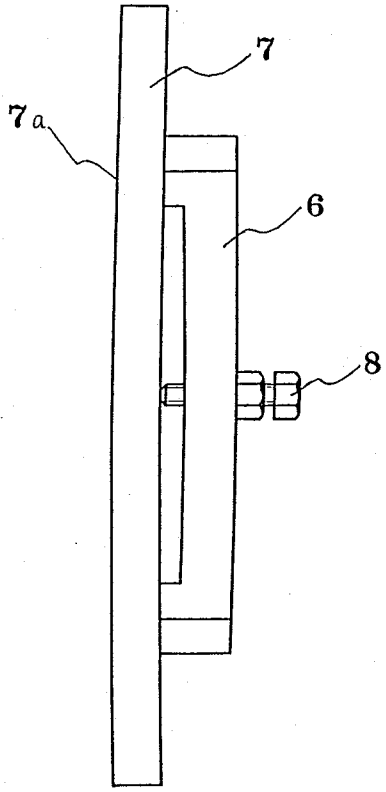
FIG. 9 is a side view of the heating plate of FIG. 8.

FIGS. 8 and 9 show a heating plate 7 having a rectangular or square shape and having means for providing the desired convexity to its heating surface *7a*. The means includes a cross-shaped member 6 having leg portions fixed to the surface of the plate 7 on the side opposite to the heating surface *7a* by any suitable means such as welding or screws, and a bolt 8 threadably mounted through the center crossing of the member 6 so that the tip end of the bolt 8 may be pressed against the center of the adjacent plate surface when the bolt is screwed in. By screwing in the bolt 8, the heating plate 7 can be bent so that a convex surface may be presented by the heating surface *7a*. In order to bend the plate so as to form a convex surface on its heating surface, other methods may be utilized. For example, a plate may be deformed permanently by use of a press so as to provide a heating plate according to the invention. Alternatively, the heating plate of the invention can be manufactured by providing a plate with such a stress that causes a concave shape on the contact surface, then machining the concave surface flat, and finally relieving the stress in the plate so that it may deformed in opposite way to have a convex shape on the heating contact surface.

Figure 5:
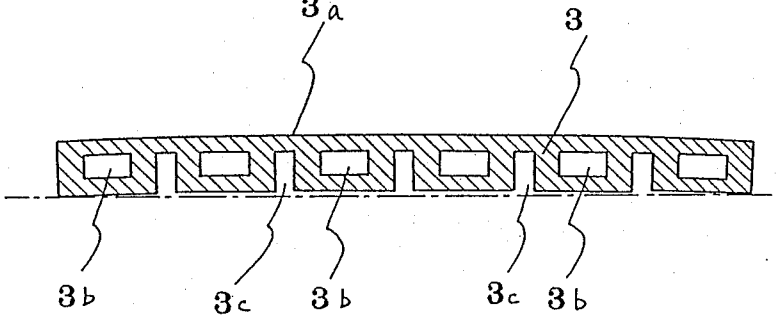
FIG. 5 is a cross-sectional view of the heating plate of FIG. 4, but showing the state when it has been heated up in non-engagement condition.
Figure 4:
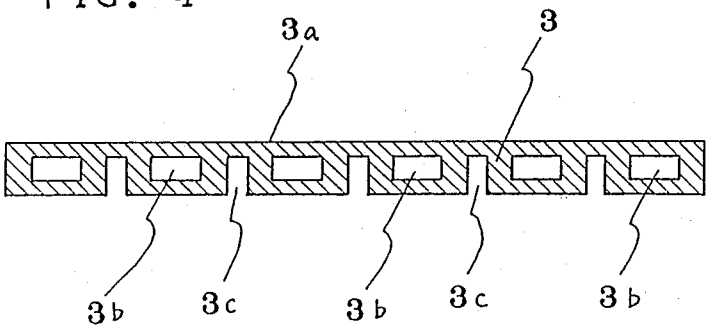
FIG. 4 is a cross-sectional view of a modified heating plate of the present invention, adapted to be heated by any suitable heated fluid such as steam and shown in the state when it is still cold.

As a further alternative method for providing the convexity, the expansion of a heating plate taking place when it is heated up may be utilized. FIGS. 4 and 5 exemplify a heating plate which can present a convex surface on the heating surface under the influence of thermal expansion of the plate itself. As shown in FIG. 4, the heating plate 3 is provided on the side opposite to the heating surface *3a* a series of grooves *3c*, and a passage *3b* for allowing heating steam to flow therethrough is formed within each projection defined by any two grooves *3c* or by an outermost groove and its adjacent lateral edge of the plate 3. When steam under pressure as a heating medium is introduced through the passages *3b* the plate 3 is heated and expands accordingly. The stress created by the expansion tends to be concentrated in the area adjacent the heating surface *3a* because of the grooves *3c* which then absorb the stress produced adjacent thereto. As a result, the heating plate 3 will be deformed to form a convexity on the heating surface *3a* in the direction across the extension of the grooves *3c*. Though not shown in the drawings, addition of grooves extending across the grooves *3c* can make it possible to curve the heating surface *3a* in all directions across the heating surface.

It is to be understood that the heating plate of the present invention is not limited to use by which the plate is placed in contact engagement only by its own weight, but also to such use by which the plate is placed in engagement state by positive pressing for assisting in providing the convexity to the heating surface. Additionally, the heating plate may be provided with insulator over the surfaces other than its heating surface.

While the invention has been described and illustrated specifically with reference to the desired embodiments and other possible modifications, it is to be understood that the invention can be changed or modified in various other ways without departing from the spirit or scope thereof.

What is claimed is:

1. A rigid heating plate in a dryer for drying a sheet of wood veneer by heating said plate to a desired level of temperature and placing the plate in heat conducting position where one surface of said heating plate on the side thereof which is adjacent said veneer sheet is engaged with the veneer sheet, wherein said plate when heated to said level of temperature and placed away from said heat conducting position has said one surface formed slightly convex.

2. A heating plate in a veneer dryer according to claim 1, wherein said heating plate is of a rectangular shape and wherein the convexity of said one surface of the heating plate is formed by a surface curved in one direction along any two opposite parallel sides of the plate.

3. A heating plate in a veneer dryer according to claim 1, wherein said heating plate is of a rectangular shape and wherein the convexity of said one surface of the heating plate is formed by a surface curved in all directions across said one surface.

4. A heating plate in a veneer dryer according to claim 1, wherein the convexity of said one surface of the heating plate is formed by a plurality of planes.

5. A heating plate in a veneer dryer according to claim 1, wherein said one surface of the plate is placed in direct contact engagement with the veneer sheet in said heat conducting position.

6. A heating plate in a veneer dryer according to claim 1, wherein said dryer includes a heat conducting member interposed between the plate and the veneer sheet and said one surface of the plate is engaged with the veneer sheet indirectly by way of said heat conducting member in said heat conducting position.

7. A heating plate in a dryer for drying a sheet of wood veneer wherein said heating plate is heated and periodically placed with a surface of said plate in conductive heat transfer relationship relative to a surface of said sheet of wood veneer, said plate being constructed such that said surface of said plate is convex when said plate is heated and not in said heat transfer relationship, said convexity being selected such that thermal stresses within said plate cause said surface of said plate to become substantially planar when said plate is in said heat transfer relationship.

* * * * *